United States Patent [19]

von der Eltz et al.

[11] 4,157,595

[45] Jun. 12, 1979

[54] PROCESS FOR THE UNIFORM DYEING OF TEXTILE MATERIAL WEBS WITH THE AID OF A UNIFORM APPLICATION OF LIQUOR

[75] Inventors: Hans-Ulrich von der Eltz, Frankfurt am Main; Siegfried Glander, Bad Soden am Taunus, both of Fed. Rep. of Germany

[73] Assignee: Hoechst Aktiengesellschaft, Frankfurt am Main, Fed. Rep. of Germany

[21] Appl. No.: 858,898

[22] Filed: Dec. 8, 1977

[30] Foreign Application Priority Data

Dec. 10, 1976 [DE] Fed. Rep. of Germany ..... 2655973

[51] Int. Cl.[2] ..... D06B 23/26

[52] U.S. Cl. ..... 8/151; 8/158; 68/13 R

[58] Field of Search ..... 8/151, DIG. 16, 158; 68/13 R, 22 R, 202, 203, 12 R; 100/47; 162/252, DIG. 6, DIG. 10; 427/8; 364/470

[56] References Cited

U.S. PATENT DOCUMENTS

| | | | |
|---|---|---|---|
| 3,619,359 | 11/1971 | Keyes | 162/DIG. 6 |
| 3,691,940 | 9/1972 | Hays et al. | 100/47 X |
| 3,862,553 | 1/1975 | Schwemmer et al. | 118/8 X |
| 3,936,665 | 2/1976 | Donoghue | 162/DIG. 10 |

*Primary Examiner*—Philip R. Coe

*Attorney, Agent, or Firm*—Curtis, Morris & Safford

[57] ABSTRACT

Process for the uniform application of treatment liquors to textile material webs with the aid of a measurement of the total moisture content applied, wherein, in the course of the material run, immediately behind a machine for applying the liquor to the continuously fed material, several measuring position are arranged transversely to the transport direction of the material and measurements of the total moisture are made by means of a contactless method, the measuring pulses determined in this manner are transmitted to the control elements of the preceding liquor application unit and there the amount of liquor pick-up from several separately controllable sections, which are distributed across the width of liquor application unit, is controlled in agreement with the measured values of the total mixture.

16 Claims, No Drawings

PROCESS FOR THE UNIFORM DYEING OF TEXTILE MATERIAL WEBS WITH THE AID OF A UNIFORM APPLICATION OF LIQUOR

Various methods are known in practice for applying treatment liquors containing dyes and chemicals to web-shaped textile materials. Examples of these methods which may be mentioned are padding, slop-padding, spraying, electrostatic deposition, foaming-on, printing-on and also suction through the material. The application of liquors with the aid of suction cloths has also been already described. With all these methods of application, however, there has hitherto been no possibility of automatically controlling a pre-set amount of application uniformly across the width of the textile web.

Referring in this connection to the padding mangle which is certainly the best known application machine and at the same time also the best designed, the impregnating operation is followed hereby the mechanical squeezing-out of the liquid surplus. The monitoring of the squeezing operation runs, however, merely by means of the mechanical control of the pressure on the rolls, which again represents a limitation of this control, for although the moisture pick-up drops with increasing pressure it is not inversely proportional to the pressure. In addition the liquor pick-up is dependent on the material speed. It is well known, therefore, to the expert that there is often a differing moisture content on the material after the squeezing.

The only accurate control possibilities regarding the amount of applied liquor consist in the gravimetric determination of the high-moisture application (100% liquor pick-up and more) or in the determination of the weight per unit area. The latter method using radioactive elements is expensive and is effected at a single position.

The object of the present invention is a process for the uniform application of treatment liquors to textile material webs in the continuous dyeing or finishing of fiber materials, with the aid of a measurement of the total moisture content applied to the textile material, with which process the difficulties known from the state of the art in this field of work, which were discussed above, are removed.

This object is achieved according to the invention when, in the course of the material run, immediately behind a machine for applying the liquor to the continuously fed material, several measuring positions are arranged transversely to the transport direction of the material and measurements of the total moisture are made at these positions on the textile material by means of a contactless method, the measuring pulses determined in this manner are transmitted with low inertia to the control elements of the preceding liquor application unit and there the amount of liquor pick-up from several separately controllable sections of the application unit, which are distributed across the width of the previously mentioned liquor application unit, is controlled in agreement with the measured values of the total moisture obtained at the corresponding measuring positions.

According to the present invention, the value of the total moisture determined at the measuring position is the basis for the regulation, for example, of the roll pressure on the padding mangle, and this is effected by means of electronic and/or pneumatic control elements. In order to ensure a useful regulation of the liquor pick-up, the liquor application machine is divided into at least two, more advantageously three or, still better, four fields, which in turn are located opposite two to four measuring positions across the width of the material web after the liquor application machine. The most certain way is to provide at least as many measuring positions across the width of the material as there are control possibilities available on the application machine.

In the claimed process, it is appropriate if the desired liquor pick-up of the fabric (liquor pick-up desired value) is pre-set by being programmed into a limiting value circuit and in this way, a reference system for the liquor application is provided. According to this novel technique, from the first moment of start-up of the liquor application process, for example, the roll pressure of the padding mangle increase across the whole width until the liquor pick-up (liquor pick-up actual value) produced and then measured corresponds to this limiting value. During the course of the application operation, the amount of moisture present at any moment is measured continously across the width of the material web and, likewise continuously and even almost without delay, it is adjusted to the set limiting value of the moisture in such a manner that the same value of liquor pick-up results across the whole width of the material.

The setting of the squeezing pressure required for a uniform moisture application across the width of the material is effected preferably automatically by means of electronic control. It is certainly also possible to carry out manually a mechanical adjustment, that is to say, a setting of the squeezing pressure. For this purpose the squeezing pressures are set in such a manner that, across the width of the material web, the measured values of the moisture assume a pre-set value. Within the framework of a reference system operating under such conditions, any other moisture value produces an indication deviating from the pre-set limiting value on an optical indicating instrument (continous recorder, digital indicating instrument, oscillograph). With the aid of a manual actuation of valves this value must again be brought into coincidence with the limiting value pre-set for a certain grade of material. This method also operates with a negligible delay but is dependent on the speed of reaction of the operator. Needle settings or needle deflections can also be used for the method.

The principle of the present invention consists in the immediate, that is to say inertia-less or undelayed, transmission of measured values of the liquor pick-up to, for example, the padding mangle squeezing pressure. In this process the rolls themselves, as well as, with appropriate circuitry, each squeezing section, can be controlled individually so that a faultless adjustment of the liquid application to the fabric surface or to the fabric structure is effected. As mentioned already the transmission of the measured values is effected without inertia. This means that, for example, faulty portions arising due to differing dye application can no longer occur.

The process according to the invention can, of course, also be adapted to liquor application systems other than the padding mangle, if there are possibilities of variation across the width of the material. Thus, for example, instead of the roll pressure of the padding mangle, the liquor pressure at different spray heads, across the width of the material, can be altered according to the pre-set or programmed liquor pick-up. Basically it is also possible to control the amount of foam emerging from different slot nozzles. In further analogy, for example in an application method with the aid of the suction cloth, the renewed pick-up of liquors can also be influenced by controlled squeezing of the suction cloth.

According to the claimed mode of operation the contactless moisture measurement of the textile material and the control of the liquor application with low inertia can be effected with the aid of a measuring method based on microwave absorption or microwave reflection, or on the basis of infrared absorption or infrared reflection. In this connection use may advantageously be made according to the invention of the device described in copending application Ser. No. 858,893. This concerns a device for the simultaneous determination of the moisture content at the sides and in the center of textile webs, with which device the amount of liquor applied to sheet-like structures can be measured even in the region of high moisture and which consists of microwave transmitters (horn transmitters) distributed across the width of the material web and connected to a microwave oscillator, and appropriately located microwave receivers. The measuring principle of the equipment which operates by microwave absorption and which has the purpose of determining the influence on the microwave power which passes from the transmitters through the material web to the receivers, is used to control the application machine. The measuring equipment can be provided with as many horn transmitters and receivers as there are control possibilities existing on the application machine. The measurement of the liquor pick-up is effected across the width of the material web immediately behind the liquor application machine. The indication of the measured value follows without delay and gives a control pulse in the mV range, which is employed for setting the application machine. The accuracy of the measurement lies between 0.5 and 3%. By modulation of the microwave frequency of the oscillator (for example, 2.4 to 3.7 cm wavelength), a time-consuming adjustment of the equipment is dispensed with and the position of the material web as well as the fluttering of the same during the measurement no longer have an effect.

Compared with a measuring method which has already been introduced in practice, and which operates with the aid of a reflected microwave beam and which possesses only a single measuring position which traverses to and fro in a zig-zag manner across the material, the device described here has the advantage that it possesses at least three horn transmitters across the width of the material web with appropriately located receivers. With a traversing guidance of the measuring head there is not only a great tendency for faults in the equipment but the corrections are, in addition, much too time-consuming. Moreover, in this traversing measurement, the running of the material adversely affects the measured result.

Compared with the hitherto customary methods for controlling the liquor application, a whole series of advantages which characterize the new technique can be achieved with the aid of the process according to the invention:

As mentioned already above, the new mode of operation results in a much lower loss of material due to uneven dyeing in contrast to the hitherto empirical settings for the desired application amount and for a uniform liquor application across the width of the material.

During the material run, a changeover can be made, without particular difficulty, to the liquid treatment of a different textile grade, thus permitting the use of smaller yardages. The organization in a works is therefore much more flexible. A much more even dyeing is obtained across width of the material web.

The moisture application can be set with impeccable reproducibility across the textile web. This is possible at any time, even if the same grades of material are run at intervals of weeks or even months.

With different material grades, different application conditions are often necessary to achieve the same moisture. By means of pre-set moisture values determined for the grade and the automatic adjustment of the values during the liquor application, the transferability of a recipe from the one article to the other article is possible directly and without recalculation.

We claim:

1. A process for the uniform application of treatment liquors to textile material webs in the continuous dyeing or finishing of fibre materials, with the aid of a measurement of the total moisture content applied to the textile material, wherein, in the course of the material run, immediately behind a machine for applying the liquor to the continuously fed material, several measuring positions are arranged transversely to the transport direction of the material and measurements of the total moisture are made at these positions on the textile material by means of a contactless method, the measuring pulses determined in this manner are transmitted with low inertia to the control elements of the preceding liquor application unit and there the amount of liquor pick-up from several separately controllable sections of the application unit, which are distributed across the width of the previously mentioned liquor application unit, is controlled in agreement with the measured values of the total moisture obtained at the corresponding measuring positions.

2. A process as claimed in claim 1, wherein at least three measuring positions are provided, across the width of the material, behind the liquor application unit.

3. A process as claimed in claim 1, wherein as many measuring positions are distributed, across the width of the material, as there are control possibilities available on the liquor application unit.

4. A process as claimed in claim 1, wherein the desired liquor pick-up is programmed into a limiting value circuit and in this way a reference system is provided for the liquor application.

5. A process as claimed in claim 1, wherein the liquor application is controlled automatically.

6. A process as claimed in claim 1, wherein the liquor application is controlled manually.

7. A process as claimed in claim 1, wherein the liquor application is controlled with the aid of the squeezing pressure of the padding rolls.

8. A process as claimed in claim 7, wherein the roll pressure is controlled by means of electronic and/or pneumatic control elements.

9. A process as claimed in claim 8, wherein the roll pressure is controlled manually, according to the indication of the measuring instrument, by the use of pneumatic means.

10. A process as claimed in claim 7, wherein the roll pressure is controlled in individual segments by means of contact pressure rolls.

11. A process as claimed in claim 10, wherein the pressure of each individual segment is controlled by means of a separate measuring position with accompanying control device.

12. A process as claimed in claim 1, wherein the liquor application is individually controlled with the aid of the pressure of the liquor emerging from the spray heads or with a pump.

13. A process as claimed in claim 1, wherein the liquor application is controlled with the aid of the amount of liquor or foam emerging from slot nozzles arranged in segments across the width of the material web.

14. A process as claimed in claim 1, wherein the moisture measurement of the textile material and the control of the liquor application are achieved with the aid of a measuring method based on microwave absorption or microwave reflection.

15. A process as claimed in claim 1, wherein the moisture measurement of the textile material and the control of the liquor application are achieved with the aid of a measuring method based on infrared absorption or infrared reflection.

16. A process for the uniform application of a treatment liquor to a textile material web in the continuous dyeing or finishing of fibrous materials, said process comprising the steps of continuously measuring, monitoring, and automatically controlling the total amount of moisture applied to the textile material, said measuring being carried out during the passage of the material through a unit immediately after exit from a machine for applying the liquor to the continuously fed web by means of a contactless method based on microwave adsorption wherein, at several measuring positions arranged transversally to the transport of the material, existing scatter points of the moisture content, at these positions of the textile material at that moment, are continuously determined by means of frequency-modulated microwaves so as to monitor the same, while the web is traveling at a constant speed and while the amount of liquor pick-up of several controllable sections, which are distributed across the width in a preceding liquor application unit, is controlled, said controlling being in response to the measured value of the total moisture obtained at the corresponding measuring points, which values have been previously determined and transmitted with low impedance to the control elements.

* * * * *